US005568658A

United States Patent [19]

Madden

[11] Patent Number: 5,568,658

[45] Date of Patent: Oct. 29, 1996

[54] CONVERTIBLE BED-CHAIR ASSEMBLY

[76] Inventor: Jennifer M. Madden, 8601 Glen Myrtle, Apt. 212, Norfolk, Va. 23505

[21] Appl. No.: 503,864

[22] Filed: Jul. 18, 1995

[51] Int. Cl.[6] ..... A47C 13/00; A47C 19/12

[52] U.S. Cl. ..... 5/174; 5/400; 5/308; 297/118

[58] Field of Search ..... 5/174, 400, 2.1, 5/93.2, 308; 297/118

[56] References Cited

U.S. PATENT DOCUMENTS

| | | | |
|---|---|---|---|
| 76,148 | 2/1868 | Bell . | |
| 1,674,554 | 4/1928 | Leamy . | |
| 2,563,752 | 11/1949 | Rowland . | |
| 3,120,404 | 2/1964 | Bramming | 297/118 |
| 4,097,942 | 7/1978 | Bridger | 5/93.2 |
| 4,198,718 | 4/1980 | Ballard | 5/93.2 |
| 5,170,519 | 3/1992 | Meade | 5/37.1 |

FOREIGN PATENT DOCUMENTS

| | | | |
|---|---|---|---|
| 921179 | 4/1947 | France | 5/174 |

*Primary Examiner*—Alexander Grosz
*Attorney, Agent, or Firm*—Larson and Taylor

[57] ABSTRACT

A convertible bed-chair assembly comprises first and second solid assembly members which fit together in two different configurations. Corresponding planar surfaces of the members each include a cavity therein which is formed by an internal wall of the corresponding member and is unbounded at a first sidewall of the member. The assembly members each further include one or more recesses in a side wall thereof opposite the first sidewall. A pair of simple latches connect the members together in first, bed configuration wherein the first sidewalls of the members are in abutment and the cavities cooperate to form a concavity for receiving a futon or mattress. A further pair of simple latches connect the members together in a second, chair configuration wherein the first planar surfaces are in abutment and the first and second cavities form an internal storage space, and the recesses of the members are aligned to form a seat or seats.

3 Claims, 2 Drawing Sheets

CONVERTIBLE BED-CHAIR ASSEMBLY

FIELD OF THE INVENTION

The present inv ntion relates to a convertible bed-chair assembly which converts from a bed to a functional chair.

BACKGROUND OF THE INVENTION

Various types of convertible sofa or couch devices have been developed which allow conversion from a sofa to a bed by manipulating two or more sections that are movable relative to each other. Generally, the conversion employs hinges or folds between the sections and, accordingly, the mechanisms employed are, in general, relatively complicated and cumbersome. Further, hinges are subject to mechanical failure resulting from the stress and strain of repeated use.

Patents of interest in this field include U.S. Pat. Nos. 5,170,519 (Meade); 2,563,752 (Rowland); 1,674,554 (Leamy); and 76,148 (Bell). The patents disclose various forms of furniture devices which, in one configuration, form a bed or a couch.

SUMMARY OF THE INVENTION

It is an object of the present invention to provide a convertible bed-chair assembly without hinges or folds which is simple in construction, easy to use and reliable in operation.

It is a further object of the present invention to provide a convertible bed-chair assembly with a simple means for securing the assembly both in a bed configuration and a chair configuration.

It is still another object of the present invention to provide a convertible bed-chair assembly capable of comfortably seating at least two persons when assembled in the chair configuration.

In accordance with a preferred embodiment thereof the convertible bed-chair assembly of the invention comprises two assembly members with side walls and end walls and first and second opposed, parallel, planar surfaces. The first planar surface of each assembly member includes a cavity which is formed by an internal wall of the corresponding member and is unbounded at a first side wall. The other side wall opposite the unbounded side wall including at least one recess therein. In the bed configuration, the assembly members are the two members are connected together such that the unbounded side walls of each member are in abutment and the cavities are joined to form a large concavity for receiving a mattress or futon. The assembly members are secured together by connecting means connecting such as a latch or locking connector. In the chair configuration, the first planar surfaces of each assembly are in abutment such that the cavities form an internal storage space which can be used, for example, to store pillows, a folded mattress, or a thin futon mattress. The side wall recesses are aligned to form a seat of a chair. The assembly members are held together by further connecting means such as a latch or locking connector.

The means for connecting the assembly members together in the bed and chair configurations preferably comprises a pin chain latch or in an alternative embodiment, a pivotable hook and fixed eyelet arrangement.

In accordance with a preferred embodiment, the side wall including the at least one recess is scalloped so as to form two recesses providing two seats in the chair configuration.

Other features and advantages of the invention will be set forth in, or apparent from, the following detailed description of the preferred embodiment of the invention.

DESCRIPTION OF THE PREFERRED EMBODIMENTS

Figure 1:
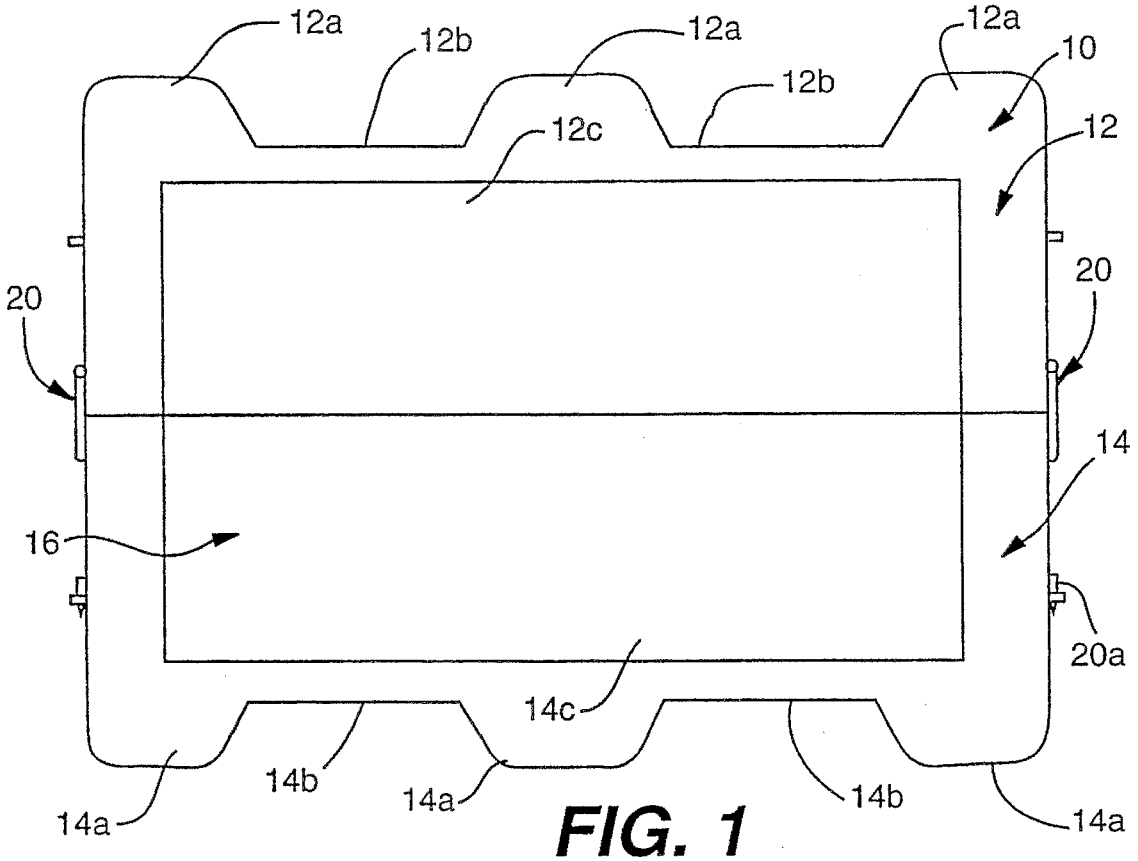
FIG. 1 is a plan view of a convertible bed-chair assembly constructed according to a preferred embodiment of the invention, as assembled to form a bed.
Figure 2:
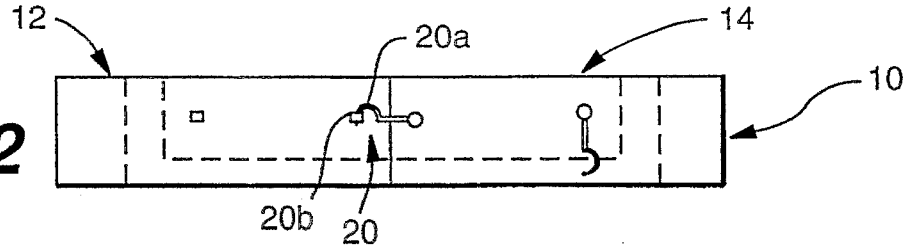
FIG. 2 is an end elevation of the convertible bed-chair assembly of FIG. 1 as assembled to form a bed.

Referring to FIGS. 1 and 2 of the drawings, a first configuration of the assembly members or components of the invention is shown. The invention comprises first and second solid, e.g., wood, components 12 and 14, which, in the configuration of FIGS. 1 AND 2, are connected together to form a bed or mattress support, generally denoted 10. In the illustrated embodiment each component or member 12 and 14 is generally rectangular in shape and includes a scalloped outer or side wall formed by alternating projections and recesses 12*a* and 12*b*, and 14*a* and 14*b*, respectively. In the illustrated embodiment, two pairs of recesses 12*b* and 14*b* are formed between three projecting portions or projections 12*a* and 14*a*, as shown. The components 12 and 14 also include respective rectangular cavities 12*c* and 14*c* which are formed in a broad face thereof and which are open on the side of component opposite to the scalloped wall. Thus, a large rectangular concavity, which is denoted 16 and which is adapted to receive a feather mattress or futon mattress (not shown), is formed when the two cavities 12*c* and 14*c* are joined. As shown in FIG. 2, components 12 and 14 of the bed 10 are held together by a conventional hook and eyelet latch 20, one of which is provided at end of the bed 10. Latch 20 comprises a pivotable hook member 20*a* pivotably attached to component 14 and a fixed eyelet 20*b* affixed to component 12. It will be appreciated that other latches or connectors can be used and that, for example, a conventional pin and chain connector can be employed.

Figure 3:
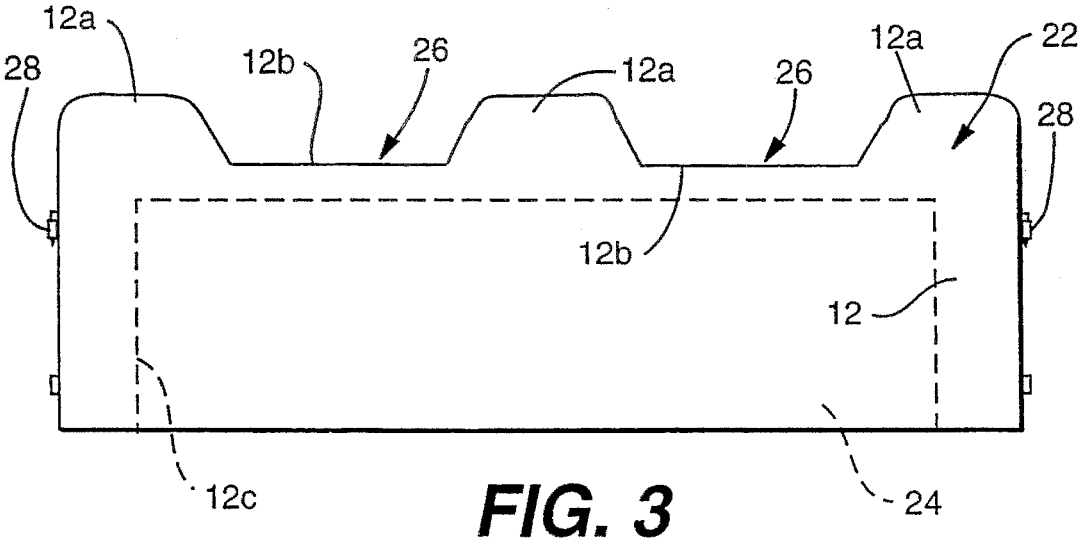
FIG. 3 is an side elevation of the convertible bed-chair assembly of FIG. 1 as assembled to form a bed.
Figure 4:
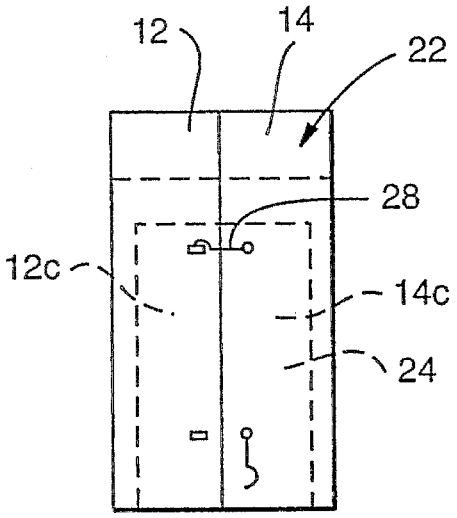
FIG. 4 is an end elevation of the convertible bed-chair assembly of FIG. 1 as assembled to form a chair
Figure 5:
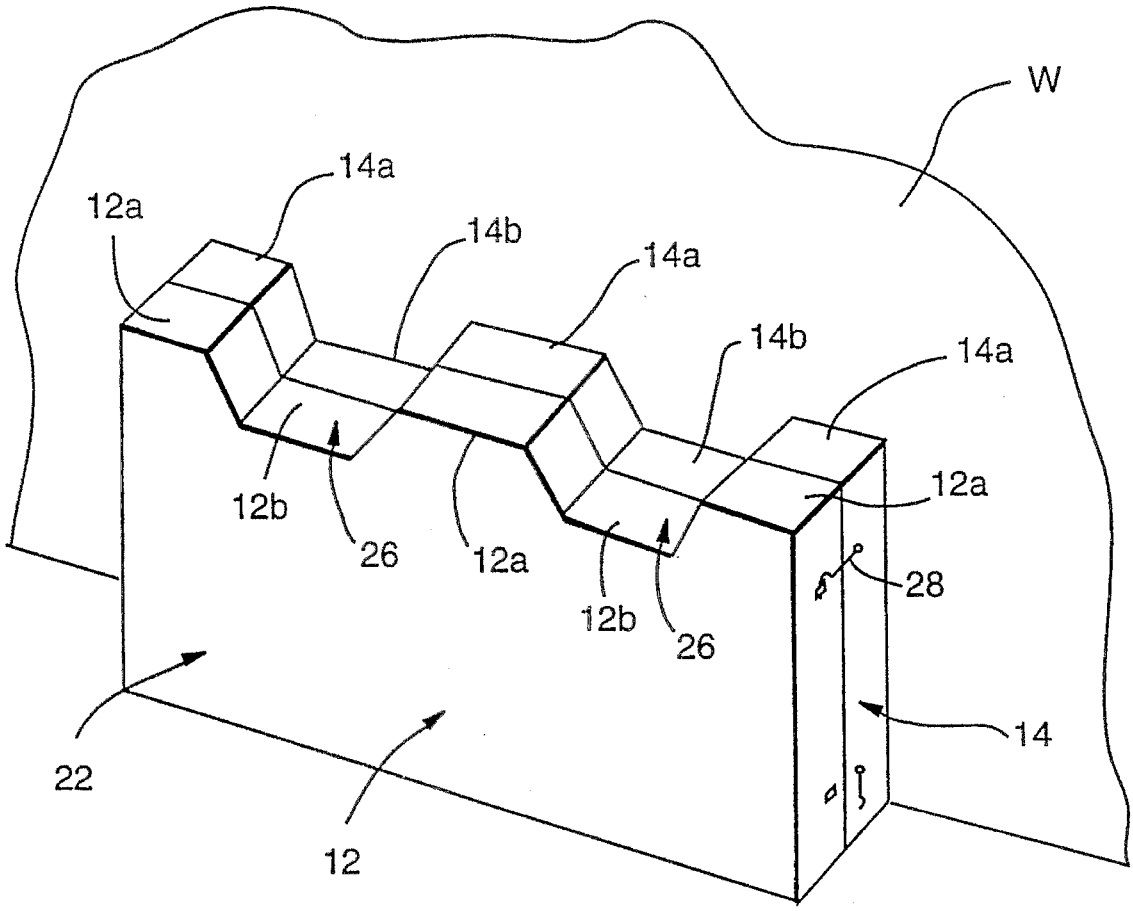
FIG. 5 is a perspective view showing the convertible bed-chair assembly of FIG. 1 as assembled to form a chair positioned up against a wall.

Referring to FIGS. 3 to 5 of the drawings, a second configuration of the assembly members or components of the invention is shown. In this configuration, the two solid components 12 and 14 are connected together in an upright (vertical) position with the scalloped side wall facing up to form a chair generally denoted 32. As can best be seen in FIG. 4, the rectangular cavities 12*c* and 14*c* face each other to form an internal storage space 24 for storing pillows, a feather mattress, a futon or the like. The projections 12*a* and 14*a* and recesses 12*b* and 14*b* are aligned in side-by-side relation to form a pair of seats 26. As shown in FIGS. 4 and 5, the components 12 and 14 are held together by a hook and eyelet 28, one of which is provided at the side of the chair 22. Again, it will be appreciated that other latches or connectors can be used. FIG. 5 shows a perspective view of the chair 22 which is further stabilized by pushing it against a wall W which then provides the back of the chair.

Although the present invention has been described to specific exemplary embodiments thereof, it will be understood by those skilled in the art that variations and modifications can be effected in these exemplary embodiments without departing from the scope and spirit of the invention.

What is claimed is:

1. A convertible bed-chair assembly comprising first and second assembly members having side walls and end walls and first and second opposed substantially parallel, substantially planar surfaces, said first planar surfaces of said members each including a cavity therein which is formed by an internal wall of the corresponding member and is unbounded at a first sidewall of said corresponding member, said assembly members each including at least one recess in a side wall thereof opposite said first sidewall, first securing means for connecting said members together in a first, bed configuration wherein the first sidewalls of said members are in abutment and said cavities cooperate to form a concavity for receiving a futon or mattress and second securing means for connecting said members together in a second, chair configuration wherein said first planar surfaces are in abutment and said first and second cavities form an internal storage space and the recesses of said members are aligned to form a seat.

2. The convertible bed-chair assembly of claim 1, wherein at least one of said securing means comprises a pivotable hook and fixed eyelet.

3. The convertible bed-chair assembly of claim 1, wherein said sidewall including the at least one recess is of a scalloped shape forming at least two recesses.

* * * * *